US009156045B1

(12) United States Patent
Preston et al.

(10) Patent No.: US 9,156,045 B1
(45) Date of Patent: Oct. 13, 2015

(54) DRIPLESS ATOMIZING NOZZLE

(71) Applicants: Daniel Edward Preston, Loveland, OH (US); Bryan D. Peters, Cincinnati, OH (US)

(72) Inventors: Daniel Edward Preston, Loveland, OH (US); Bryan D. Peters, Cincinnati, OH (US)

(73) Assignee: EXAIR CORPORATION, Cincinnati, OH (US)

( * ) Notice: Subject to any disclaimer, the term of this patent is extended or adjusted under 35 U.S.C. 154(b) by 81 days.

(21) Appl. No.: 14/242,361

(22) Filed: Apr. 1, 2014

(51) Int. Cl.

| | |
|---|---|
| ***B05B 17/00*** | (2006.01) |
| ***B05B 7/12*** | (2006.01) |
| ***B05B 1/30*** | (2006.01) |
| ***B05B 7/08*** | (2006.01) |
| ***B05B 15/02*** | (2006.01) |
| ***B05B 1/00*** | (2006.01) |

(52) U.S. Cl.
CPC ..... *B05B 7/1272* (2013.01); *B05B 1/00* (2013.01); *B05B 1/005* (2013.01); *B05B 1/3046* (2013.01); *B05B 7/0815* (2013.01); *B05B 7/1254* (2013.01); *B05B 15/02* (2013.01)

(58) Field of Classification Search
CPC ..... B05B 1/00; B05B 7/0815; B05B 15/02; B05B 7/1254; B05B 1/005; B05B 1/3046; B05B 7/1272
USPC ..... 239/1, 8, 120, 104, 105, 290, 296, 407, 239/412, 417.3, 583
See application file for complete search history.

(56) References Cited

U.S. PATENT DOCUMENTS

| | | | | |
|---|---|---|---|---|
| 2,623,782 | A | | 12/1952 | Gustafson |
| 2,654,911 | A | | 10/1953 | Sharlip et al. |
| 2,817,600 | A | * | 12/1957 | Yahnke ..... 239/290 |
| 2,949,239 | A | * | 8/1960 | Goyette ..... 239/120 |
| 3,561,680 | A | | 2/1971 | Ott |
| 3,977,609 | A | | 8/1976 | Gallant |
| 4,465,212 | A | | 8/1984 | Boone |
| 4,579,255 | A | | 4/1986 | Frates et al. |
| 4,714,199 | A | * | 12/1987 | Heath et al. ..... 239/412 |
| 5,447,254 | A | | 9/1995 | Hoover et al. |
| 5,711,460 | A | | 1/1998 | Saito et al. |
| 6,325,853 | B1 | | 12/2001 | Hogan et al. |
| 6,443,368 | B1 | | 9/2002 | Kohls |
| 6,695,225 | B2 | | 2/2004 | Yanagida |
| 6,805,307 | B2 | | 10/2004 | Dorendorf et al. |
| 6,863,225 | B2 | | 3/2005 | Nakamura |

* cited by examiner

*Primary Examiner* — Steven J Ganey
(74) *Attorney, Agent, or Firm* — Thompson Hine LLP

(57) ABSTRACT

A dripless atomizing nozzle may include a nozzle body having a liquid orifice in fluid communication with a liquid inlet, a gas orifice in communication with a gas inlet, and a liquid passage connecting the liquid inlet and the liquid orifice, and a piston body having a piston passage communicating with the gas inlet; the nozzle body may include a connecting portion shaped to enable the piston body to be selectively removed from and attached to the nozzle body. A piston positioned in the piston passage may include a stem and a bias element connected to move the piston and stem within the piston passage such that the presence of gas above a predetermined pressure in the piston passage overcomes a force of the bias element to displace the piston to move the tip away from the liquid orifice to open the liquid orifice.

24 Claims, 3 Drawing Sheets

DRIPLESS ATOMIZING NOZZLE

TECHNICAL FIELD

The present disclosure relates to atomizing nozzles that use a pressurized gas to atomize a liquid, and more particularly, to atomizing nozzles having a component that prevents liquid from dripping from the nozzle when the pressurized gas supply is shut off.

BACKGROUND

Atomizing nozzles use a pressurized gas, typically atmospheric air under pressure, to break up a fluid supplied to the nozzle into fine particles for a variety of uses. Atomizing nozzles combine the liquid and compressed air to create a mist of particles that may be adjusted by varying the geometry of the nozzle orifice to create a spray pattern of a desired, predetermined shape.

Atomizing nozzles may be designed to provide internal-mix, external-mix, or siphon-fed operation. With an internal-mix nozzle, the liquid and pressurized air are mixed within an air cap, and the mixture exits through an orifice to produce a relatively fine atomization. Both the air and liquid provided to an internal mix atomization nozzle are provided under pressure.

External-mix nozzles have a relatively high flow rate and include a cap shaped such that the air and liquid mix after leaving the exit orifice. This enables the nozzle to accommodate relatively high liquid flow rates and allows the air and liquid flows to be adjusted independently of each other. External mix nozzles may be used with fluids having a relatively high viscosity (e.g., above 300 centipoise). Both air and liquid provided to an external mix nozzle are under pressure.

Siphon-fed atomizing nozzles may have a construction similar to that of external-mix or internal mix nozzles, except that the liquid provided to the nozzle is not under pressure. Liquids may be provided with gravity feed or lift liquids from a siphon height as much as 36 inches (91 centimeters). Siphon-fed nozzles are limited to using liquids of a relatively low viscosity (e.g., less than 200 centipoise).

Liquid that is not atomized by an atomizing nozzle may drip from the tip of the nozzle after gas pressure is removed and land on a surface that was not intended to receive the liquid. Dripless atomizing nozzles have been developed to prevent such dripping liquid from the nozzle. Dripless atomizing nozzles may include a stem that is urged against an orifice of the nozzle by a spring to close fluid flow. The force of the spring may be overcome by pressurized air, which moves the piston and stem away from the liquid orifice to enable fluid to exit the orifice and mix with air to form a spray of atomized particles. Accordingly, there is a need for a simple, effective and efficient dripless atomizing nozzle.

SUMMARY

In an embodiment, a dripless atomizing nozzle may include a nozzle body having a liquid inlet and a liquid orifice in fluid communication with the liquid inlet, and a gas inlet and a gas orifice in communication with the gas inlet, the liquid orifice and the gas orifice positioned on the body such that gas exiting the gas orifice mixes with and atomizes liquid exiting the liquid orifice; the nozzle body including a liquid passage connecting the liquid inlet and the liquid orifice; a piston body having a piston passage communicating with the gas inlet, such that the piston passage is pressurized by pressurized gas entering the gas inlet; a connecting portion on the nozzle body shaped to receive the piston body and enable the piston body to be selectively removed from and attached to the nozzle body; a piston positioned in the piston passage for slidable movement therein, the piston including a stem having a tip shaped and positioned to engage the liquid orifice; and a bias element connected to move the piston and stem within the piston passage, such that the presence of gas above a predetermined pressure in the piston passage overcomes a force of the bias element to displace the piston to move the tip away from the liquid orifice to open the liquid orifice, and the bias element displaces the piston to move the tip to engage and seal the liquid orifice in the absence of gas above the predetermined pressure in the piston passage.

In another embodiment, a dripless atomizing nozzle may include a nozzle body having a liquid inlet and a liquid orifice in fluid communication with the liquid inlet, and a gas inlet and a gas orifice in communication with the gas inlet, the liquid orifice and the gas orifice positioned on the body such that the gas exiting the gas orifice mixes with and atomizes liquid exiting the liquid orifice; the nozzle body including a liquid passage connecting the liquid inlet and the liquid orifice; a piston body connected to the nozzle body, the piston body having a piston passage communicating with the gas inlet, such that the piston passage is pressurized by pressurized gas entering the gas inlet; a piston positioned in the piston passage for slidable movement therein; a bias element connected to move the piston within the piston passage; and a stem extending from the piston, the stem having a tip with a resilient seal, the resilient seal shaped and positioned to engage the liquid orifice and make a seal therewith; wherein the presence of gas above a predetermined pressure in the piston passage overcomes a force of the bias element to displace the piston to move the tip and resilient seal away from the liquid orifice to open the liquid orifice, and the bias element displaces the piston to move the resilient seal to engage and seal the liquid orifice in the absence of gas above the predetermined pressure in the piston passage.

In yet another embodiment, a method for forming a dripless atomizing nozzle may include providing a nozzle body with a liquid inlet and a liquid orifice in fluid communication with the liquid inlet, and a gas inlet and a gas orifice in communication with the gas inlet, the liquid orifice and the gas orifice positioned on the body such that gas exiting the gas orifice mixes with and atomizes the liquid exiting the liquid orifice; providing the nozzle body with a liquid passage connecting the liquid inlet and the liquid orifice; providing a piston body with a piston passage; providing the nozzle body with a connecting portion shaped to receive the piston body and enable the piston body to be selectively removed from and attached to the nozzle body; connecting the piston body to the nozzle body such that the piston passage communicates with the gas inlet; placing a piston in the piston passage for slidable movement therein, the piston including a stem having a tip shaped and positioned to engage the liquid orifice; and providing a bias element connected to move the piston and stem within the piston passage such that the presence of gas above a predetermined pressure in the piston passage overcomes a force of the bias element to displace the piston to move the tip away from the liquid orifice to open the liquid orifice, and the bias element displaces the piston to move the tip to engage and seal the liquid orifice in the absence of gas above the predetermined pressure in the piston passage.

In still another embodiment, a method for converting a standard atomizing nozzle to a dripless atomizing nozzle may include providing a nozzle body with a liquid inlet and a liquid orifice in fluid communication with the liquid inlet, and a gas inlet and a gas orifice in communication with the gas inlet, the liquid orifice and the gas orifice positioned on the body such that gas exiting the gas orifice mixes with and atomizes liquid exiting the liquid orifice; providing the nozzle body with a liquid passage connecting the liquid inlet and the liquid orifice and a connecting portion; removing a stem retainer cap and a stem from the connecting portion of the nozzle body; attaching a piston body to the nozzle body at the connecting portion, such that a piston passage within the piston body communicates with the gas inlet; placing a piston in the piston passage for slidable movement therein, the piston including a stem having a tip shaped and positioned to engage the liquid orifice; and providing a bias element connected to move the piston and stem within the piston passage such that the presence of gas above a predetermined pressure in the piston passage overcomes a force of the bias element to displace the piston to move the tip away from the liquid orifice to open the liquid orifice, and the bias element displaces the piston to move the tip to engage and seal the liquid orifice in the absence of gas above the predetermined pressure in the piston passage.

Other objects and advantages of the disclosed dripless atomizing nozzle will be apparent from the following description, the accompanying drawings, and the appended claim.

DETAILED DESCRIPTION

Figure 1:
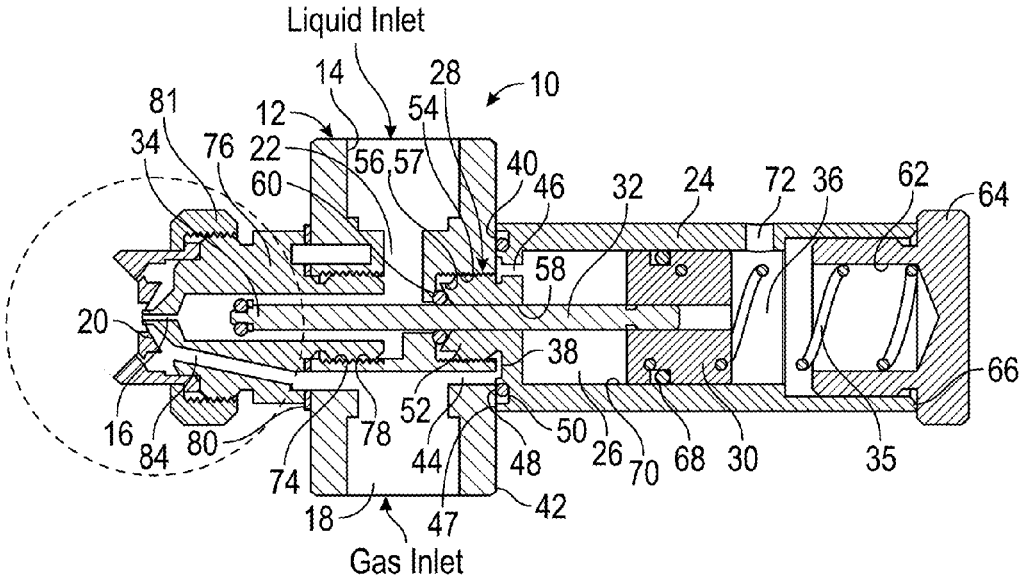
FIG. 1 is a side elevation in section of the disclosed dripless atomizing nozzle embodied in an external-mix nozzle.
Figure 2:
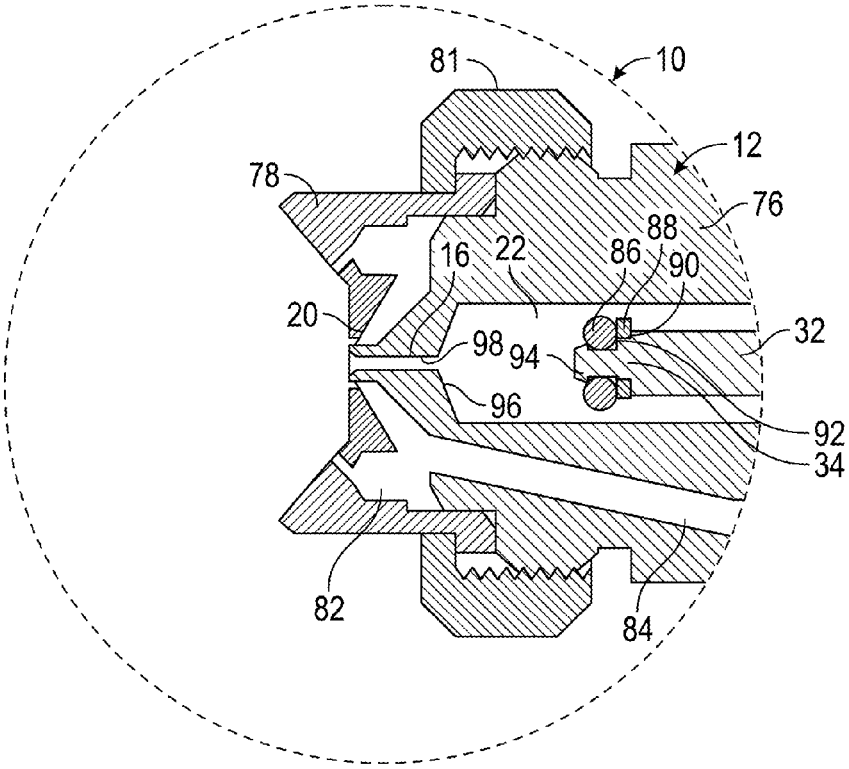
FIG. 2 is a detail side elevation in section of the nozzle of FIG. 1.

As shown in FIGS. 1 and 2, the disclosed dripless atomizing nozzle may take the form of an external-mix, dripless atomizing nozzle, generally designated 10. The nozzle 10 may include a nozzle body 12 having a liquid inlet 14 and a liquid orifice 16 in fluid communication with the liquid inlet, and a gas inlet 18 in communication with a gas orifice 20. The liquid orifice 16 and the gas orifice 20 may be positioned on the nozzle body 12 such that pressurized gas exiting the gas orifice 20 mixes with and atomizes liquid exiting the liquid orifice 16.

In embodiments, the gas orifice 20 may take the form of a plurality of discrete openings positioned symmetrically around a central liquid orifice 16. The nozzle body 12 may include a liquid passage 22 that may connect the liquid inlet 14 and the liquid orifice 16. In an embodiment, the liquid inlet may be connected to a source of liquid under pressure (not shown), and the gas inlet may be connected to a source of gas under pressure (not shown). The nozzle 10 may utilize compressed gas in the form of atmospheric air, nitrogen, or another gas.

The atomizing nozzle 10 may include a piston body, generally designated 24, having an internal piston passage 26 that communicates with the gas inlet 18 such that the piston passage may be pressurized (e.g., above atmospheric or ambient pressure) by pressurized gas entering the gas inlet. The piston passage 26 may be elongate and generally cylindrical in shape, extending in a direction away from the nozzle body 12. The nozzle body 12 may include a connecting portion, generally designated 28, that is shaped to receive the piston body 24 and enable the piston body to be selectively removed from and attached to the nozzle body easily.

The piston body 24 may include a piston 30 positioned in the piston passage 26 for slidable movement therein. The piston 30 may include a stem 32 having a tip 34 shaped and positioned to engage the liquid orifice 16. The piston body 24 may include a bias element 35 in the form of a coil spring that may be connected to move the piston 30 and stem 32 within the piston passage 36. In an embodiment, the coil spring 35 may be positioned on a side of the piston opposite the nozzle body 12 and urge the piston toward the nozzle body.

The presence of gas above a predetermined pressure in the piston passage 26 between the piston 30 and the nozzle body 12 may overcome the force of the coil spring 35 and displace the piston 30 and stem 32, moving the tip 34 away from the liquid orifice 16 to open the liquid orifice and allow liquid from the liquid inlet 14 to exit the liquid orifice. The coil spring 35 displaces the piston 30 to move the tip 34 to engage and seal the liquid orifice in the absence of gas above the predetermined pressure in the piston passage 26 between the piston and the nozzle body 12.

In an embodiment, the piston body 24 may include an annular channel 38 in an end face 40 adjacent and abutting the face 42 of the nozzle body 12. The annular channel 38 may communicate with the gas inlet 18 by way of a hole 44 formed in the nozzle body 12. Pressurized gas entering the gas inlet 18 may be conveyed from the gas inlet, through the hole 44 in the nozzle body 12, to the annular channel 38, and from the annular channel through a hole 46 in the piston body 24 to the piston passage 26 to pressurize the piston passage 26 in the space formed by the piston 30, the piston body 24, and the face 42 of the nozzle body 12.

A gas-tight seal may be formed between an end face 47 of the piston body 24 and the face 42 of nozzle body 12. The gas-tight seal may take the form of an O-ring 48 retained within an O-ring channel 50 in the piston body 24 located radially outboard of the annular channel 38 and the hole 46. Alternatively, the gas-tight seal may take the form of an O-ring in a channel (not shown) formed in the face 42 of the nozzle body 12.

The piston body 24 may include a cylindrical neck portion 52 that engages the connecting portion 28 of the nozzle body 12 to form a connection between the piston body and the nozzle body. The connecting portion 28 may include a threaded engagement 54 between the nozzle body 12 and the piston body 24. In a specific embodiment, the connecting portion 28 may include an inner annular wall 56 defining a recess 57 shaped to receive the neck portion 52 of the piston body 24. The threaded engagement 54 may exist between the inner wall 56 and the neck portion 52.

The neck portion 52 may include a central bore 58 shaped to receive the stem 32 therethrough and interconnect the piston passage 26 and the liquid passage 22. The bore may include a stem seal in the form of an O-ring 60 between the nozzle body 12, the neck portion 52 and the stem 32. The O-ring may prevent leakage of liquid from the liquid passage 22 to the piston passage 26, and leakage of compressed gas from the annular channel 38 and recess 57 to the liquid passage, while allowing movement of the stem 32 relative to the neck portion 52.

The stem 32 may be shaped to extend through the piston passage 26 and the liquid passage 22. The bias element in the form of a coil spring 35 may be seated within a recess 62 formed in an end cap 64 that may be threaded into an open end 66 of the piston body 24 on a side of the piston 30 opposite the nozzle body 12. The piston 30 may include a seal in the form of an O-ring 68 that forms a gas-tight seal between the piston and the inner wall 70 of the piston body 24. In an embodiment, the piston body 24 may include a hole 72 positioned to allow ambient air to enter and escape the piston passage 26 on the side of the piston 30 opposite the nozzle body 12 to facilitate sliding movement of the piston 30 within the piston passage.

The nozzle body 12 may include a nozzle opening 74 that receives a nozzle projection 76 in a threaded connection 78. The threaded connection 78 may include a resilient gasket 80 to provide a gas- and liquid-tight seal between the projection 76 and the nozzle body 12. The nozzle projection 76 also may include a portion of the liquid passage 22. The nozzle projection 76 may be shaped to receive an air cap 78 at its end, which may be secured by an air cap retainer in the form of a nut 81 that is threaded on the end of the nozzle projection 76. The air cap 78 may include the gas orifice 20 and form a plenum 82 with the nozzle projection 76 that communicates with a gas passage 84 that connects to the gas inlet 18. Thus, pressurized gas entering the inlet 18 may flow through the gas passage 84 to the plenum 82 and out the orifice 20, which in the embodiment of FIGS. 1 and 2 may take the form of a plurality of discrete orifices. In other embodiments, the orifice 20 may take the form of an annular opening that is continuous or substantially continuous about the liquid orifice 16.

The tip 34 of the stem 32 may include a resilient seal 86 in the form of an O-ring that may be seated against a backing washer 88 mounted on the stem 32. The resilient seal 86 may be shaped and positioned to engage the liquid orifice 16 and make a seal therewith, when the gas pressure in the piston passage 26 drops below a predetermined pressure. This allows the bias element 35 to urge the piston 30 toward the piston body 12 (to the left in FIGS. 1 and 2) so that the resilient seal 86 engages the end of the liquid passage 22.

In an embodiment, the tip 34 of the stem 32 may include a first shoulder 90 that is shaped to receive the backing washer 88, and a second shoulder 92 that is shaped to receive the resilient seal 86. Also in an embodiment, the tip 34 may include a flared head 94 wherein the resilient seal 86 is captured between the flared head 94 on a first side adjacent the liquid orifice 16, and the second shoulder 92 and the backing washer 88 on an opposite side. The resilient seal in the form of an O-ring 86 may be made from a material selected from synthetic rubber, fluoropolymers, nylon, and neoprene.

The liquid orifice 16 may include a beveled wall 96 facing the liquid passage 22. The resilient seal 86 may be shaped and positioned to engage the beveled wall 96 to form a seal therewith when the tip 34 of the stem 32 is urged against the beveled wall by the bias element 35. The beveled wall 96 may form a reduced diameter portion 98 that includes the beveled wall. The liquid passage 22 thus may interconnect the reduced diameter portion 98 with the liquid inlet 14, wherein the liquid passage 22 may transition to the reduced diameter portion by the beveled wall 96.

Figure 3:
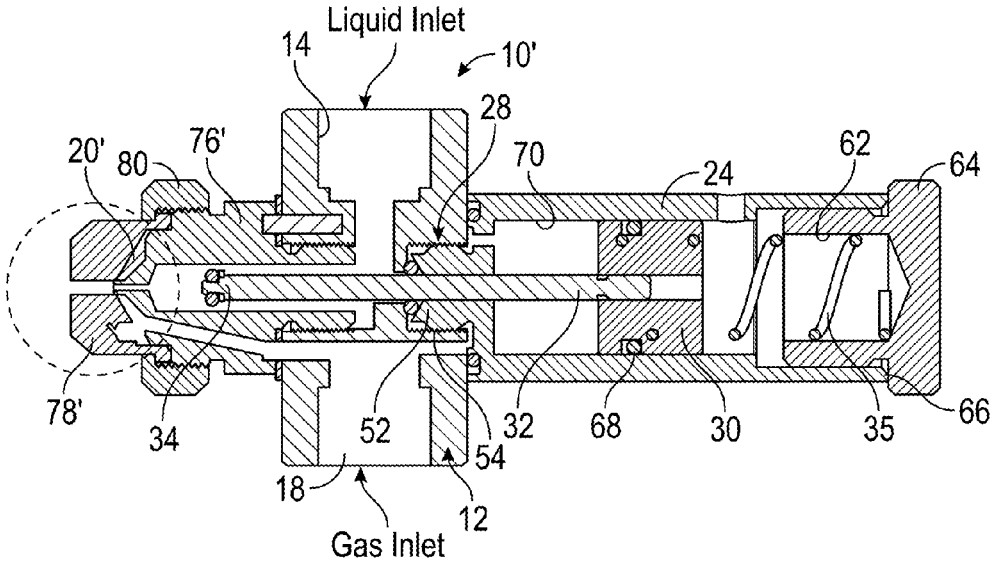
FIG. 3 is a side elevation in section of the disclosed dripless atomizing nozzle embodied in an internal-mix nozzle.
Figure 4:
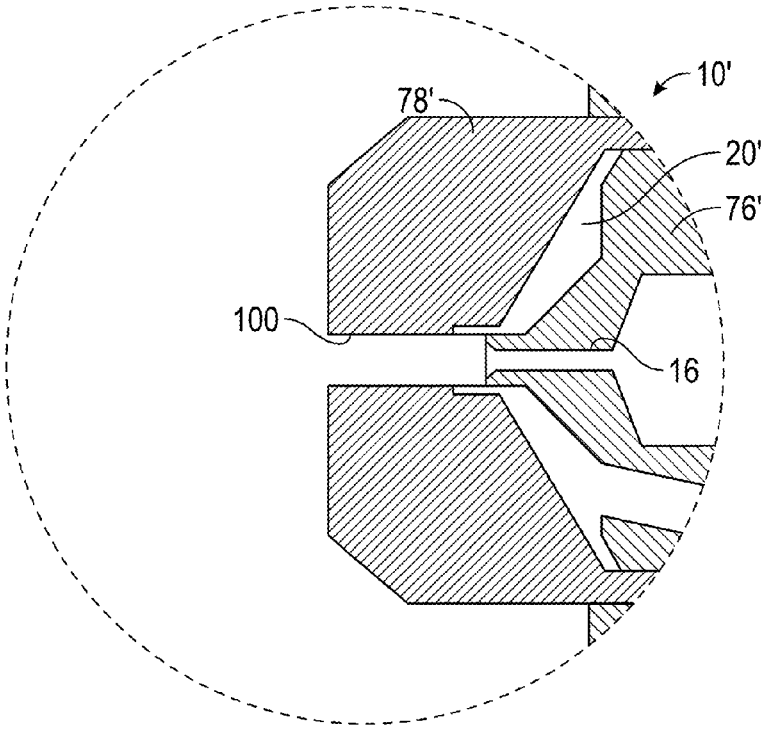
FIG. 4 is a detail side elevation in section of the nozzle of FIG. 3.

FIGS. 3 and 4 show an embodiment of the disclosed dripless atomizing nozzle in the form of an internal-mix, no-drip nozzle 10'. The nozzle 10' is identical to the nozzle 10 disclosed in FIGS. 1 and 2 and described above in all respects, except that the nozzle projection 76' may include a modified air cap 78' that forms a passage 100 that communicates with the gas orifice 20' and the liquid orifice 16. The nozzle projection 76' may be configured to eject liquid into the passage 100, where it mixes with compressed gas from the gas orifice 20'. Thus, an atomized mixture of compressed gas and liquid particles may exit the passage 100 as a shaped mist spray.

Figure 5:
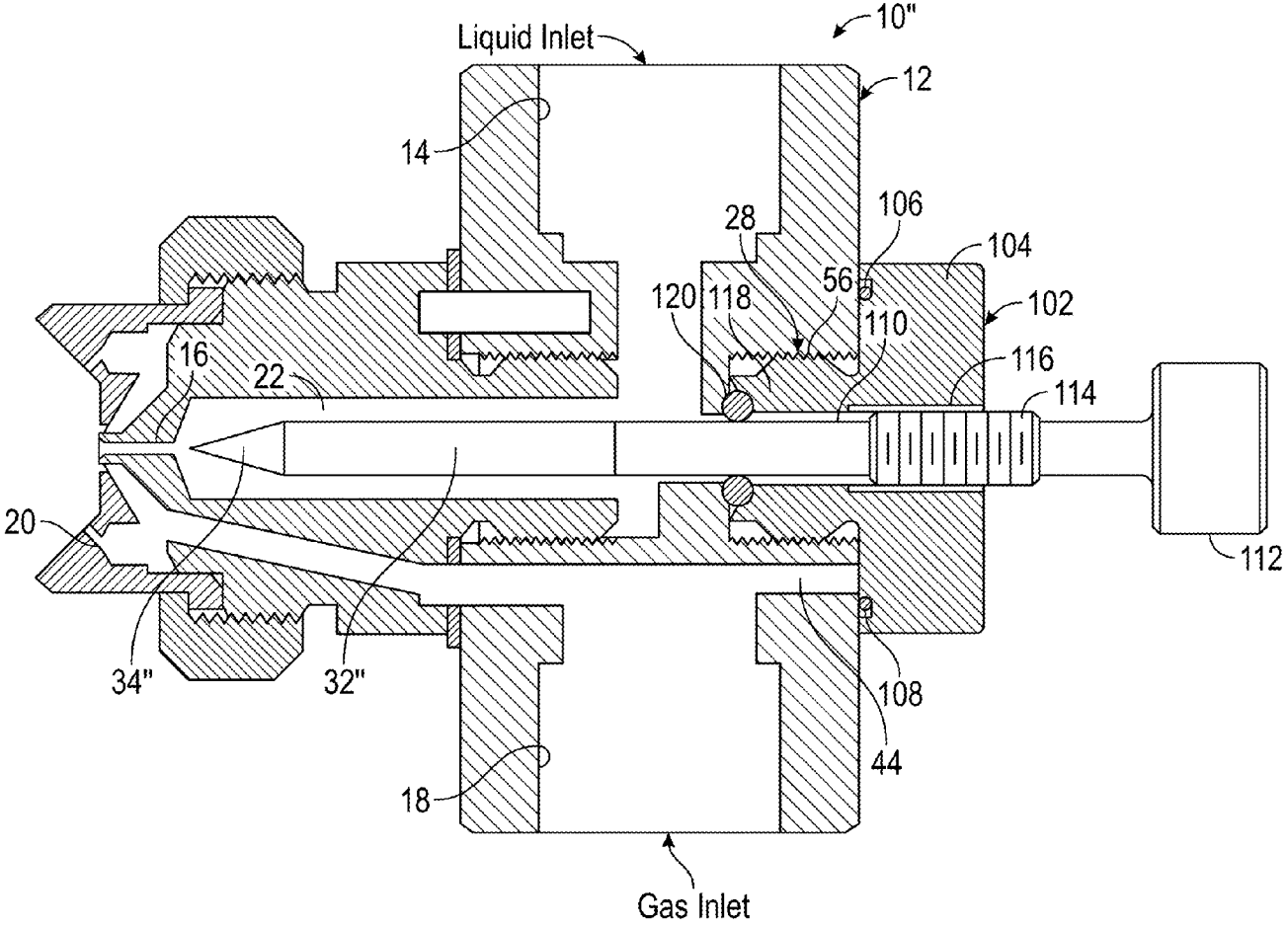
FIG. 5 is a side elevation in section of the nozzle of FIG. 1, in which the nozzle body is fitted with a stem retainer in place of the piston body.

As shown in FIG. 5, the dripless atomizing nozzle 10, 10' may be modified from a dripless nozzle to a standard (i.e., not dripless) atomizing nozzle, generally designated 10", and back again easily, by removing the piston body 24 (FIGS. 1 and 3) and replacing it with a stem retainer, generally designated 102. The stem retainer 102 may include a stem retainer cap 104 having a seal in the form of an O-ring 106 that may be positioned within an annular recess 108 positioned radially outboard of the hole 44. The retainer cap 104 may include a passage 110 shaped to receive the stem 32". The stem 32" may be modified to include a knurled knob 112 at an end, and include a threaded shank section 114 that may engage a corresponding threaded section 116 in the passage 110. This threaded engagement may permit adjustment of the stem 32" relative to the liquid passage 22 in the nozzle body 10" so that the tip 34" may selectively engage the liquid orifice 16, and thus seal off liquid flow from the liquid orifice, or be backed off, as shown in FIG. 5, to allow liquid flow through the orifice 16.

The retainer cap 104 may include a neck portion 118 that is threaded and engages the threaded portion 56 of the connecting portion 28 of the nozzle body 12 similar to the engagement of the nozzle body with the piston body 24 of the embodiments of FIGS. 1-4. The retainer cap 104 also may include a seal in the form of an O-ring 120 that forms a seal between the stem 32", the neck portion 118, and the nozzle body 12 to prevent fluid leakage from the liquid passage 22 outwardly through the passage 110.

Thus, the nozzle body 12 may be modified easily to receive either the stem retainer 102, or converted to include the piston body 24 and its associated stem 34 and provide a dripless operation. This conversion may be accomplished easily by unscrewing the stem retainer cap 104 from the nozzle body 12 at the connecting portion 28, then replacing it by screwing in the piston body 24 into the same opening 57 of the connecting portion. No modifications are needed to be made to the nozzle body 12 itself to convert the atomizing nozzle 10" to a dripless atomizing nozzle 10, 10'. An advantage of this convertible design is that it may reduce the inventory of parts needed to made the dripless nozzles 10, 10' and the standard nozzle 10" because the same nozzle body 12 may be used for each, as well as the nozzle components.

A method for converting a standard atomizing nozzle 10" to a dripless atomizing nozzle 10, 10' may include providing a nozzle body 12 with a liquid inlet 14 and a liquid orifice 16 in fluid communication with the liquid inlet, and a gas inlet 18 and a gas orifice 10 in communication with the gas inlet. The liquid orifice 16 and the gas orifice 18 may be positioned on the body 12 such that gas exiting the gas orifice mixes with and atomizes liquid exiting the liquid orifice. The nozzle body 12 may be provided with a liquid passage 22 connecting the liquid inlet 14 and the liquid orifice 16, and a connecting portion 28. The stem retainer cap 104 and stem 32" may be removed from the connecting portion 28 of the nozzle body 12.

The piston body 24 (FIGS. 1 and 3) may be attached to the nozzle body 12 at the connecting portion 28, such that a piston passage 26 within the piston body communicates with the gas inlet 14. A piston 30 may be placed in the piston passage 26 for slidable movement therein, the piston including a stem 32 having a tip 34 shaped and positioned to engage the liquid orifice 16. A bias element 35 may be positioned in the piston passage 26 and connected to move the piston 30 and stem 32 within the piston passage such that the presence of gas above a predetermined pressure in the piston passage overcomes a force of the bias element to displace the piston to move the tip away from the liquid orifice to open the liquid orifice. The bias element 35 may displace the piston 30 to move the tip 34 to engage and seal the liquid orifice 16 in the absence of gas above the predetermined pressure in the piston passage 26.

A method for forming a dripless atomizing nozzle 10, 10' (FIGS. 1, 2, 3 and 4) may include the steps of providing a nozzle body 12 with a liquid inlet 14, and a liquid orifice 16 in fluid communication with the liquid inlet, and a gas inlet 18 and a gas orifice 20 in fluid communication with the gas inlet. The liquid orifice 20 and the gas orifice 18 may be positioned on the body such that gas exiting the gas orifice mixes with and atomizes liquid exiting the liquid orifice 16. The nozzle body 12 may be provided with a liquid passage 22 that may connect the liquid inlet 14 and the liquid orifice 16. The nozzle 10, 10' may be provided with a piston body 24 having a central piston passage 26. The nozzle body 12 may be provided with a connecting portion 28 shaped to receive the piston body 24 and enable the piston body to be selectively removed from and attached to the nozzle body.

The piston body 24 may be connected to the nozzle body 12 such that the piston passage 26 communicates with the gas inlet 18. A piston 30 may be placed in the piston passage 26 for slidable movement therein. The piston 30 may include a stem 32 having a tip 34 that may be shaped and positioned to engage the liquid orifice 16. A bias element 35, which may be in the form of a coil spring, may be connected to move the piston 30 and the stem 32 within the piston passage 26 such that the presence of gas above a predetermined pressure in the piston passage may overcome a force of the bias element to displace the piston to move the tip away from the liquid orifice 16 to open the liquid orifice, and the bias element may displace the piston to move the tip to engage and seal the liquid orifice in the absence of gas above the predetermined pressure in the piston passage.

Thus, when a supply of pressurized gas applied to the atomizing nozzle 10, 10' is shut off, the nozzle positively seals off the flow of liquid through the orifice 16, thereby eliminating the possibility of drips. The disclosed atomizing nozzles 10, 10' may be used in any situation that standard atomizing nozzles may be used, including applications in which the liquid is siphon-fed to the liquid inlet 14 (FIG. 1). There is no need to provide a separate compressed gas line to control the no-drip mechanism of the disclosed nozzles 10, 10'. The same compressed gas, typically compressed air, may be used to combine and atomize liquid in a variety of patterns and also used to pressurize the piston passage 26 in the piston body 24 to displace the piston away from the orifice 16, thereby displacing the tip 34 of the stem 32 away from the orifice to allow liquid to flow through the orifice from the inlet 14. This design does not change flow rates from standard (i.e., not no-drip) nozzles.

In one particular application, the predetermined pressure supplied to the gas inlet 18 may be approximately 30 pounds per square inch gauge (psig). The required predetermined pressure may be higher or lower, depending upon the force of the bias element 35 against the piston 30. The dripless atomizing nozzle 10, 10' may be made of steel, stainless steel or other corrosion-resistant steel, aluminum, bronze, or brass, or made up of components comprised of combinations of one or more of these materials.

While the forms of apparatus and methods herein describe constitute preferred embodiments of the disclosed dripless atomizing nozzle, it is to be understood that the invention is not limited to these precise forms of apparatus and methods, and that changes may be made therein without departing from the scope of the invention.

What is claimed is:

1. A dripless atomizing nozzle comprising:

a nozzle body having a liquid inlet and a liquid orifice in fluid communication with the liquid inlet, and a gas inlet and a gas orifice in communication with the gas inlet, the liquid orifice and the gas orifice positioned on the body such that gas exiting the gas orifice mixes with and atomizes liquid exiting the liquid orifice;

the nozzle body including a liquid passage connecting the liquid inlet and the liquid orifice;

a piston body having a piston passage communicating with the gas inlet, such that the piston passage is pressurized by pressurized gas entering the gas inlet;

a connecting portion on the nozzle body shaped to receive the piston body and enable the piston body to be selectively removed from and attached to the nozzle body;

a piston positioned in the piston passage for slidable movement therein, the piston including a stem having a tip shaped and positioned to engage the liquid orifice; and a bias element connected to move the piston and stem within the piston passage, such that the presence of gas above a predetermined pressure in the piston passage overcomes a force of the bias element to displace the piston to move the tip away from the liquid orifice to open the liquid orifice, and the bias element displaces the piston to move the tip to engage and seal the liquid orifice in the absence of gas above the predetermined pressure in the piston passage.

2. The nozzle of claim 1, wherein the piston body includes an annular channel communicating with the gas inlet, and the piston body includes a hole communicating with the annular channel and the piston passage, such that pressurized gas entering the gas inlet is conveyed from the gas inlet to the annular channel, and from the annular channel through the hole to the piston passage to pressurize the piston passage.

3. The nozzle of claim 2, further comprising a gas-tight seal between the piston body and the nozzle body, the gas-tight seal located outboard of the annular channel and the hole.

4. The nozzle of claim 1, wherein the connecting portion includes a threaded engagement between the nozzle body and the piston body.

5. The nozzle of claim 1, wherein the piston body includes a neck portion, the neck portion engaging the connecting portion of the nozzle body to form a connection between the piston body and the nozzle body.

6. The nozzle of claim 5, wherein the connecting portion includes a recess shaped to receive the neck portion.

7. The nozzle of claim 5, wherein the neck portion includes a bore shaped to receive the stem therethrough and interconnecting the piston passage and the liquid passage.

8. The nozzle of claim 7, wherein the bore includes a stem seal between the nozzle body, the neck portion, and the stem, the stem seal preventing leakage of liquid and gas between the liquid passage and the piston passage, and allowing movement of the stem relative to the neck portion.

9. The nozzle of claim 1, wherein the stem is shaped to extend through the piston passage and the liquid passage.

10. The nozzle of claim 1, wherein the bias element is a spring seated in the piston passage and urging against the piston.

11. The nozzle of claim 10, wherein the piston body includes a removable end cap, and the spring is seated against the end cap.

12. The nozzle of claim 1, further comprising a stem retainer cap, the stem retainer cap shaped to engage the connecting portion and be interchangeable with the piston body; the stem retainer cap receiving a second stem that is adjustably positionable relative thereto such that positioning of the second stem relative to the liquid orifice regulates fluid flow through the liquid orifice.

13. A dripless atomizing nozzle comprising:

a nozzle body having a liquid inlet and a liquid orifice in fluid communication with the liquid inlet, and a gas inlet and a gas orifice in communication with the gas inlet, the liquid orifice and the gas orifice positioned on the body such that gas exiting the gas orifice mixes with and atomizes liquid exiting the liquid orifice;

the nozzle body including a liquid passage connecting the liquid inlet and the liquid orifice;

a piston body connected to the nozzle body, the piston body having a piston passage communicating with the gas inlet, such that the piston passage is pressurized by pressurized gas entering the gas inlet;

a piston positioned in the piston passage for slidable movement therein;

a bias element connected to move the piston within the piston passage; and a stem extending from the piston, the stem having a tip with a resilient seal, the resilient seal shaped and positioned to engage the liquid orifice and make a seal therewith;

wherein the presence of gas above a predetermined pressure in the piston passage overcomes a force of the bias element to displace the piston to move the tip and resilient seal away from the liquid orifice to open the liquid orifice, and the bias element displaces the piston to move the resilient seal to engage and seal the liquid orifice in the absence of gas above the predetermined pressure in the piston passage.

14. The nozzle of claim 13, further comprising a backing washer mounted on the stem adjacent the tip, the backing washer shaped to provide a seat for the resilient seal.

15. The nozzle of claim 14, wherein the stem includes a first shoulder shaped to receive the backing washer.

16. The nozzle of claim 15, wherein the stem includes a second shoulder shaped to receive the resilient seal.

17. The nozzle of claim 16, wherein the stem includes a flared head, wherein the resilient seal is captured between the flared head on a first side, and the second shoulder and the backing washer on an opposite side.

18. The nozzle of claim 13, wherein the resilient seal is an O-ring.

19. The nozzle of claim 18, wherein the O-ring is made of a material selected from synthetic rubber, fluoropolymer, nylon, and neoprene.

20. The nozzle of claim 13, wherein the liquid orifice includes a beveled wall facing the liquid passage; and wherein the resilient seal is shaped and positioned to engage the beveled wall to form a seal therewith.

21. The nozzle of claim 20, wherein the liquid orifice includes a reduced diameter portion; and wherein the reduced diameter portion includes the beveled wall.

22. The nozzle of claim 21, wherein the liquid passage interconnects the reduced diameter portion with the liquid inlet, the liquid passage transitioning to the reduced diameter portion by the beveled wall.

23. A method for forming a dripless atomizing nozzle, the method comprising:

providing a nozzle body with a liquid inlet and a liquid orifice in fluid communication with the liquid inlet, and a gas inlet and a gas orifice in communication with the gas inlet, the liquid orifice and the gas orifice positioned on the body such that gas exiting the gas orifice mixes with and atomizes liquid exiting the liquid orifice;

providing the nozzle body with a liquid passage connecting the liquid inlet and the liquid orifice;

providing a piston body with a piston passage;

providing the nozzle body with a connecting portion shaped to receive the piston body and enable the piston body to be selectively removed from and attached to the nozzle body;

connecting the piston body to the nozzle body such that the piston passage communicates with the gas inlet;

placing a piston in the piston passage for slidable movement therein, the piston including a stem having a tip shaped and positioned to engage the liquid orifice; and providing a bias element connected to move the piston and stem within the piston passage such that the presence of gas above a predetermined pressure in the piston passage overcomes a force of the bias element to displace the piston to move the tip away from the liquid orifice to open the liquid orifice, and the bias element displaces the piston to move the tip to engage and seal the liquid orifice in the absence of gas above the predetermined pressure in the piston passage.

24. A method for converting a standard atomizing nozzle to a dripless atomizing nozzle, the method comprising:

providing a nozzle body with a liquid inlet and a liquid orifice in fluid communication with the liquid inlet, and a gas inlet and a gas orifice in communication with the gas inlet, the liquid orifice and the gas orifice positioned on the body such that gas exiting the gas orifice mixes with and atomizes liquid exiting the liquid orifice;

providing the nozzle body with a liquid passage connecting the liquid inlet and the liquid orifice and a connecting portion;

removing a stem retainer cap and a stem from the connecting portion of the nozzle body;

attaching a piston body to the nozzle body at the connecting portion, such that a piston passage within the piston body communicates with the gas inlet;

placing a piston in the piston passage for slidable movement therein, the piston including a stem having a tip shaped and positioned to engage the liquid orifice; and providing a bias element connected to move the piston and stem within the piston passage such that the presence of gas above a predetermined pressure in the piston passage overcomes a force of the bias element to displace the piston to move the tip away from the liquid orifice to open the liquid orifice, and the bias element displaces the piston to move the tip to engage and seal the liquid orifice in the absence of gas above the predetermined pressure in the piston passage.

* * * * *